US010595658B2

(12) United States Patent
D'Andrea et al.

(10) Patent No.: US 10,595,658 B2
(45) Date of Patent: Mar. 24, 2020

(54) SAFETY MAILBOX ASSEMBLY AND METHODS OF USING SAME

(71) Applicants: Michael Dominick D'Andrea, Smithville, TN (US); Lawrence Stephen Stone, Crossville, TN (US)

(72) Inventors: Michael Dominick D'Andrea, Smithville, TN (US); Lawrence Stephen Stone, Crossville, TN (US)

( * ) Notice: Subject to any disclaimer, the term of this patent is extended or adjusted under 35 U.S.C. 154(b) by 165 days.

(21) Appl. No.: 15/656,436

(22) Filed: Jul. 21, 2017

(65) Prior Publication Data

US 2019/0021535 A1 Jan. 24, 2019

(51) Int. Cl.
*A47G 29/12* (2006.01)

(52) U.S. Cl.
CPC ..... *A47G 29/1216* (2013.01); *A47G 29/121* (2013.01)

(58) Field of Classification Search
CPC ..... A47G 29/1209; A47G 29/12095; A47G 29/1216; A47G 29/121; A47G 29/16; A47G 2029/148; E04B 2/14; E04B 2/18
USPC ..... 232/17, 38, 39, 45; 248/346.01, 146, 248/156; 52/592.5, 595.6
See application file for complete search history.

(56) References Cited

U.S. PATENT DOCUMENTS

| | | | | |
|---|---|---|---|---|
| 4,875,622 | A | 10/1989 | Lents | |
| 5,071,063 | A * | 12/1991 | Overstreet | A47G 29/1209 232/17 |
| 5,361,977 | A | 11/1994 | Ogrodnick | |
| 5,937,601 | A * | 8/1999 | McDonald | B44C 3/04 232/39 |
| 6,109,519 | A * | 8/2000 | McClure | A47G 29/1216 232/17 |
| 6,123,257 | A * | 9/2000 | Guidicy | A47G 29/1216 232/17 |
| 7,163,140 | B1 | 1/2007 | Kaiser | |
| 2007/0044413 | A1* | 3/2007 | Gossett, III | A47G 29/12 52/596 |
| 2011/0030292 | A1 | 2/2011 | Oram et al. | |
| 2018/0078069 | A1* | 3/2018 | Dry | A47G 29/1216 |
| 2019/0021535 | A1* | 1/2019 | D'Andrea | A47G 29/121 |

* cited by examiner

*Primary Examiner* — William L Miller
(74) *Attorney, Agent, or Firm* — Nexsen Pruet LLC; John B. Hardaway, III

(57) ABSTRACT

A safety mailbox assembly, comprising: a substantially hollow and post-less top structure configured with a top portion of a reversible connection at a base of the top structure and including at least one mail box disposed therein; a substantially hollow and post-less bottom structure configured with a bottom portion of the reversible connection; wherein the top portion and the bottom portion connect together to reversibly connect the top structure and the bottom structure.

17 Claims, 7 Drawing Sheets

SAFETY MAILBOX ASSEMBLY AND METHODS OF USING SAME

FIELD AND BACKGROUND OF THE INVENTION

The present invention, in some embodiments thereof, relates to safety and, more particularly, but not exclusively, to roadside safety.

Roadside mailboxes are often made from mortar and brick, stone, and/or other masonry materials for various reasons including aesthetics and durability. However, these mailboxes tend to be massive, immovable, and solid structures. By necessity, these mailboxes are located on roadsides, adjacent to entrances of driveways of buildings and residences. However, being so close to the roadside, these heavy and unforgiving structures can be hazardous to wayward vehicles and their occupants when struck.

Additionally, these masonry structures are typically constructed by skilled masons, such as bricklayers and stone masons, using brick, stone, concrete and/or precast cement materials. This increases costs and/or time of constructing the mailboxes. Other negative drawbacks of these massive immovable solid heavy masonry structures include the recurring need of maintenance to correct shifting, cracking, and/or tilting.

SUMMARY OF THE INVENTION

There is provided in accordance with an aspect of the invention, a safety mailbox assembly, comprising: a substantially hollow and post-less top structure configured with a top portion of a reversible connection at a base of the top structure and including at least one mail box disposed therein; a substantially hollow and post-less bottom structure configured with a bottom portion of the reversible connection; wherein the top portion and the bottom portion connect together to reversibly connect the top structure and the bottom structure.

In an embodiment of the invention, the reversible connection is a snap fit joint.

In an embodiment of the invention, the top portion of the reversible connection is configured with a ledge on which the bottom portion hangs when the top portion and the bottom portion are snap fit to each other.

In an embodiment of the invention, the bottom portion of the reversible connection is biased for insertion into the top portion of the reversible connection.

In an embodiment of the invention, the reversible connection comprises at least one dowel with at least one counterpart aperture adapted for receipt of the dowel.

In an embodiment of the invention, the assembly further comprises at least one of at least one plastic rivet and an adhesive to reversibly connect the top structure and the bottom structure.

In an embodiment of the invention, the top structure represents at least 75% of a total height of the safety mailbox assembly.

In an embodiment of the invention, the bottom structure is 12 inches in height or less.

In an embodiment of the invention, the bottom structure has a hollow with a capacity of at least 320 lbs. of dry concrete mix.

In an embodiment of the invention, an exterior surface of at least the top structure is provided with ornamentation.

In an embodiment of the invention, the ornamentation is at least one of a wood pattern, a metal pattern, a stone pattern, a color and a design.

In an embodiment of the invention, the total height is 65 inches.

There is further provided in accordance with an aspect of the invention, a method of using a safety mailbox assembly, comprising: placing a bottom structure at a desired location; filling a hollow of the bottom structure with a weighty substance; and, reversibly connecting a top structure to the bottom structure such that a mail box disposed within the top structure faces in a desired direction.

In an embodiment of the invention, the method further comprises reconnecting the top structure to the bottom structure after a separating impact.

In an embodiment of the invention, the method further comprises affixing at least one of street number, street name, and owner name to the top structure.

In an embodiment of the invention, the method further comprises attaching a mail flag to a side of the top structure.

In an embodiment of the invention, the method further comprises driving a location stake through the bottom structure at the desired location, prior to the filling.

There is further provided in accordance with an aspect of the invention, a system for changing the aesthetic appearance of a safety mailbox assembly, comprising: a plurality of substantially hollow and post-less top structures, each with different exterior surface ornamentation, configured with a top portion of a reversible connection at a base of the top structure and including at least one mail box disposed therein; at least one substantially hollow and post-less bottom structure configured with a bottom portion of the reversible connection; wherein the bottom portion is reversibly connectable to any of the plurality of top portions to reversibly and interchangeably connect the plurality of top structures to the bottom structure and effectuating the alteration of the appearance of the safety mailbox assembly.

In an embodiment of the invention, different exterior surface ornamentation includes at least one of a wood pattern, a metal pattern, a stone pattern, a color and a design.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale, and are for purposes of illustrative discussion of embodiments of the invention. In this regard, the description taken with the drawings makes apparent to those skilled in the art how embodiments of the invention may be practiced.

DETAILED DESCRIPTION

Figure 1:
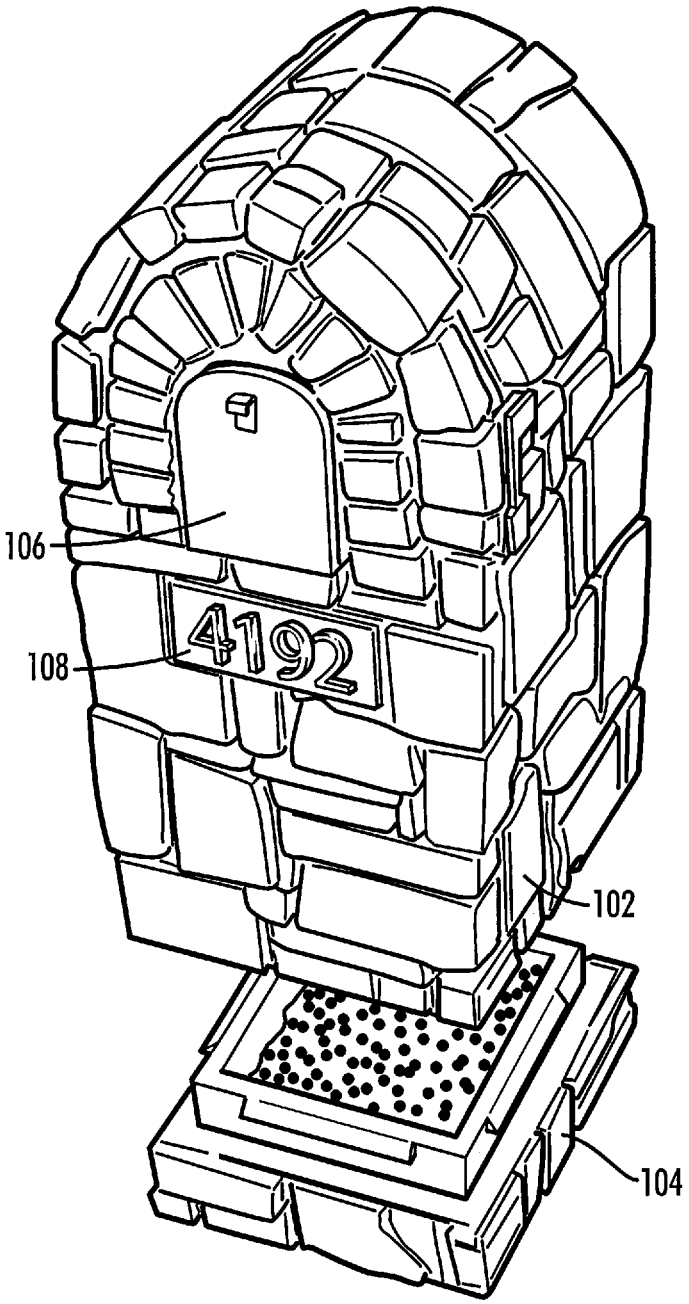
FIG. 1 is a perspective view of a safety mailbox assembly.

The present invention, in some embodiments thereof, relates to safety and, more particularly, but not exclusively, to roadside safety.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Generally, a mailbox assembly is provided which has a top structure reversibly attachable and/or reversibly separable from a bottom structure, for example in case of physical impact or optionally, for aesthetics.

FIG. 1 is a perspective view of a safety mailbox assembly 100. In an aspect, the safety mailbox assembly 100 comprises a mailbox assembly that is configured with a top structure 102 and a bottom structure 104 which are reversibly attached to one another and which are reversibly separable, for example if the top structure 102 is impacted with sufficient force to cause separation.

It is conceived that by providing a separable mailbox assembly, personal injury to automobile passengers and/or damage to automobiles running into the mailbox assembly 100 (such as shown and described in more detail with respect to FIGS. 8A-8B) will be significantly reduced, if not eliminated, over conventional, rigid and unforgiving masonry mailboxes.

In an aspect, an exterior surface of the mailbox assembly 100 is provided with ornamentation, for example to mimic stone, metal, brick, wood or any other design (e.g. sports team logos, different colors, textures, patterns). The mailbox assembly 100 optionally is a part of a system which comprises a plurality of modular and/or interchangeable top and/or bottom structures to alter the appearance of the mailbox, optionally periodically, as is desired by the owner.

In an aspect, the top structure 102 and/or the bottom structure 104 are substantially hollow (i.e. hollow but for at least one mail box and/or an added weighty substance, such as described below) and post-less (i.e. no post traverses vertically within or attached thereto for stabilizing the mailbox assembly 100). Optionally, the top structure 102 and/or the bottom structure 104 are molded. In some aspects, at least a part of the ornamentation of the exterior surface is formed as a part of the molding process. At least one flat space 108 can be provided on any, and/or on more than one, side to the top structure 102 and/or the bottom structure 104 for attaching street numbers, street name, owner name and/or other information.

The top structure 102 is provided with at least one mail box 106 for holding delivered mail and/or newspapers. In some aspects, the mail box 106 is formed during the manufacturing process with an optional door being provided to the mail box 106 to provide access to (when open) and/or deny access to (when closed) the contents of the mail box 106. Optionally, merely an opening for the mail box 106 is formed during manufacturing with a separate mail box component being inserted into the opening to provide a container for holding delivered mail. In some aspects, the top structure 102 includes a mail flag 110, for indicating that there is outgoing mail, attached to a side of the top structure 102.

Figure 5:
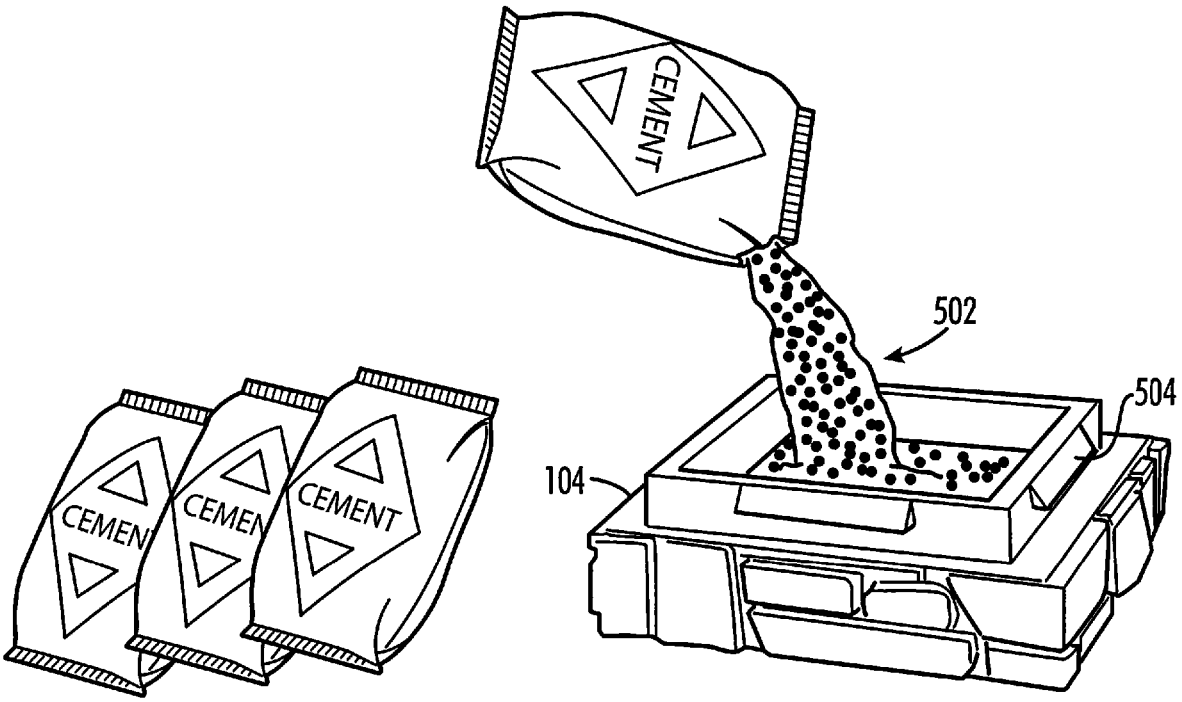
FIG. 5 is a view of a bottom structure of a safety mailbox assembly being filled with concrete mix.

The bottom structure 104 is provided with a hollow such that the hollow can be filled with at least one weighty substance or material, shown and described in more detail with respect to FIG. 5, to give an anchoring effect to the bottom structure 104. It should also be understood that the degree of anchoring provided to the bottom structure 104 partly contributes to the separation performance of the mailbox assembly 100 overall, for example the heavier the weight of the bottom structure 104, the more likely to have consistent and/or dependable separation of the top structure 102 upon impact.

The top structure 102 and the bottom structure 104 are configured to removably and/or reversibly attach to each other, for example by a snap fit joint or a counterpart male/female (e.g. dowel/aperture) mating arrangement. It should be understood that, in some aspects, the attachment configuration is one which is reversible such that upon separation of the top structure 102 from the bottom structure 104, the mailbox assembly 100 can be reassembled immediately without any additional/replacement materials. Additionally, alternatively and/or optionally, the top structure 102 and the bottom structure 104 may be attached using some other form of attachment, such as plastic rivets and/or an adhesive (which would possibly require replacement rivets and/or additional adhesive in order to reassemble the mailbox assembly 100). In some aspects, the top structure 102 is molded to sit atop the bottom structure 104 such that none of the top of the bottom structure 104 is visible. Optionally, the bottom structure 104 exhibits a tiered level when the top structure 102 is placed on top of it. In an aspect, the top structure 102 represents at least 75% of the total height of the mailbox assembly 100. Optionally, the top structure 102 represents at least 85% of the total height of the mailbox assembly 100. In some embodiments of the invention, the mailbox assembly 100 is approximately 26 in. wide. In some embodiments of the invention, the mailbox assembly 100 is approximately 33 in. long. In some embodiments of the invention, the mailbox assembly 100 is approximately 65 in. tall. These measurements are by way of example only; it should be understood the mailbox assembly 100 could exhibit virtually any combination of dimensions.

Figure 2:
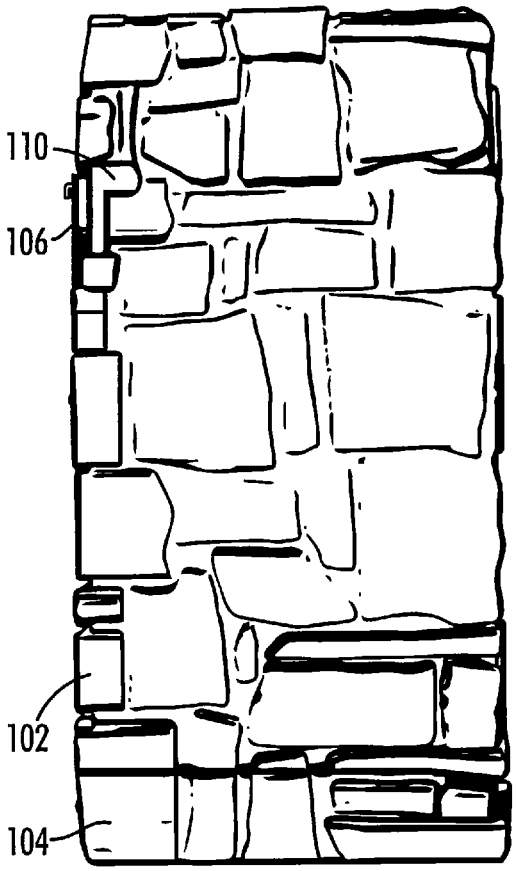
FIG. 2 is the left side view of a safety mailbox assembly.

FIG. 2 is a side view of the safety mailbox assembly 100.

Figure 3:
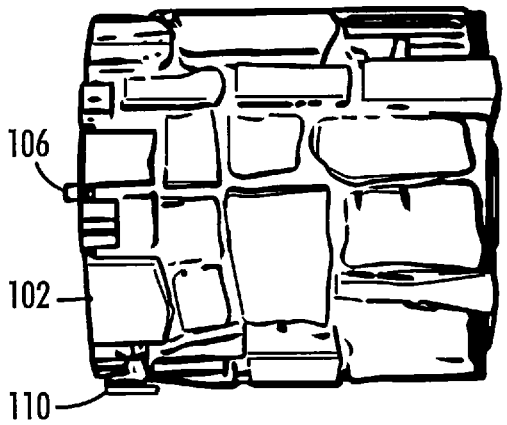
FIG. 3 is the top view of a safety mailbox assembly.

FIG. 3 is a top view of the safety mailbox assembly 100.

Figure 4:
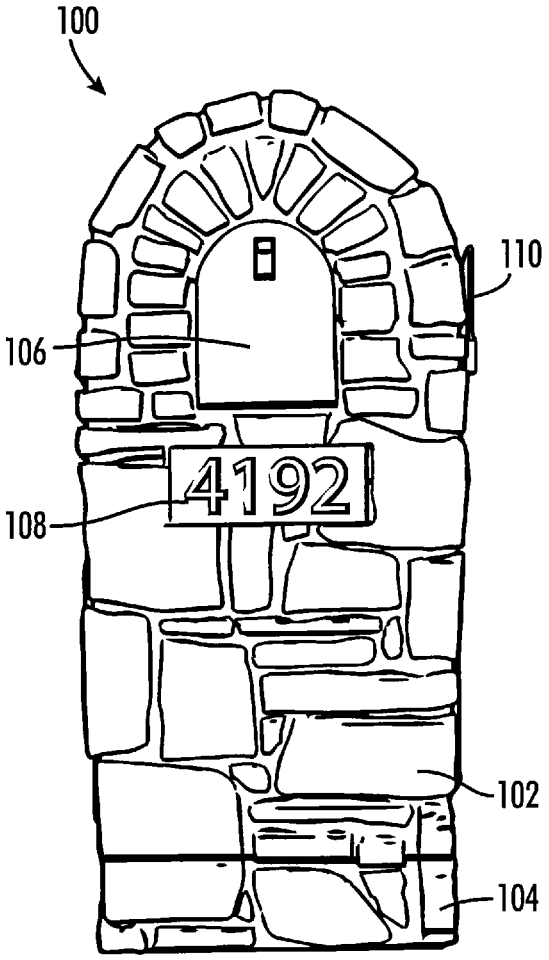
FIG. 4 is a front view of a safety mailbox assembly.

FIG. 4 is a front view of the safety mailbox assembly 100. In an aspect, the space 108 is provided to the front of the top structure 102 for adhering street numbers thereon. While shown centered, the mail box 106 can be placed virtually anywhere in the top structure 102 that is accessible by the postman and/or the home owner.

FIG. 5 is a perspective view of the bottom structure 104 of the safety mailbox assembly 100 being filled with a weighty substance 502, for example a dry concrete mix. FIG. 5 also shows a bottom snap fit portion 504 (which acts as together with a top snap fit portion 602, shown and described in more detail in FIGS. 6-7, to form a snap fit joint). In an aspect, the bottom structure 104 is configured with a low profile, for example no taller than 12 inches, such that a vehicle which hits the mailbox assembly 100 would pass safely over the bottom structure 104 without hitting it. In some aspects, the bottom structure 104 has the capacity to hold at least four (4) 80 lb. bags of dry concrete mix, plus the fluid commensurate with turning the concrete mix into finished concrete. Optionally, the bottom structure 104 has a smaller capacity than four 80 lb. bags, for example in the case of a smaller mailbox assembly 100 than what is shown and described herein.

Figure 9:
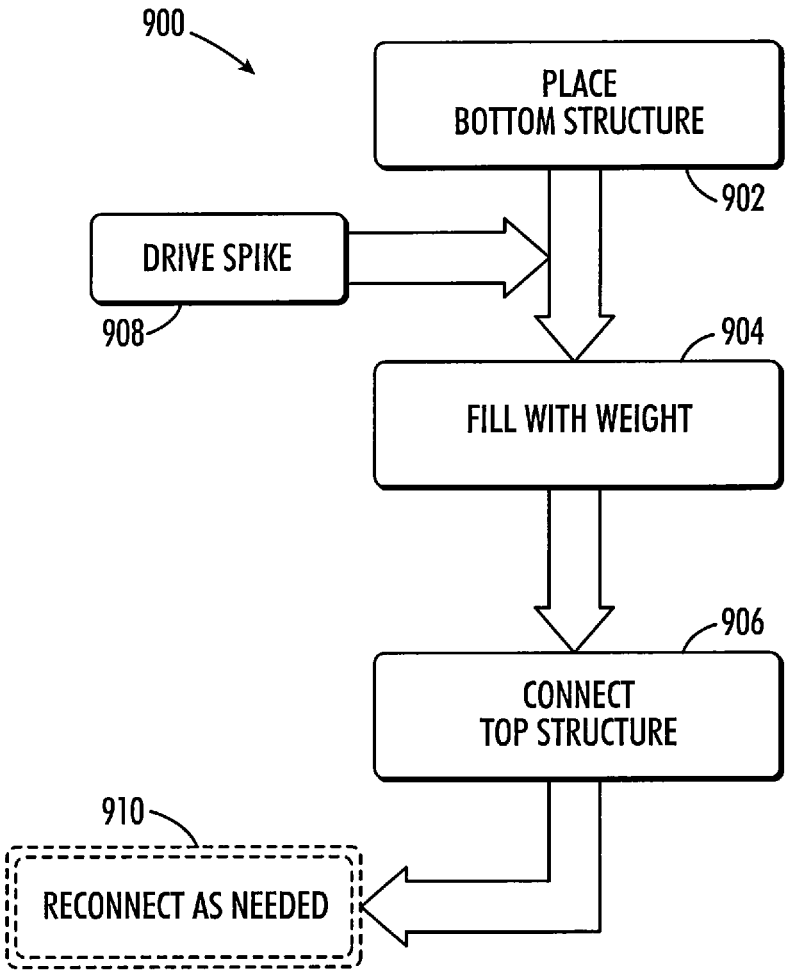

As shown in the FIG. 9 flowchart of a method 900 for using the safety mailbox assembly 100, the safety mailbox assembly 100 is assembled by placing (902) the bottom structure 104 at the desired mail box location, filling (904) the bottom structure 104 with a weighty substance 502, such as bags of dry concrete mix, and then reversibly attaching/connecting (906) the top structure 102 to the bottom structure 104 such that the mail box 106 faces in a desirable direction, for example towards a road. It should be noted that no special tools, no special skills, no hole needs to be dug and no central or core post is required for assembly of the safety mailbox assembly 100. However, a location spike may optionally be driven (908) through the bottom structure 104 and into the ground to anchor the bottom structure 104, prior to adding the weighty substance 502. It should be understood that after the safety mailbox assembly 100 is impacted with sufficient force, the top structure 102 would be separated from the bottom structure 104 and would be then reconnected (910) to the bottom structure 104 to put the mailbox assembly 100 back into a condition for use.

Figure 6:
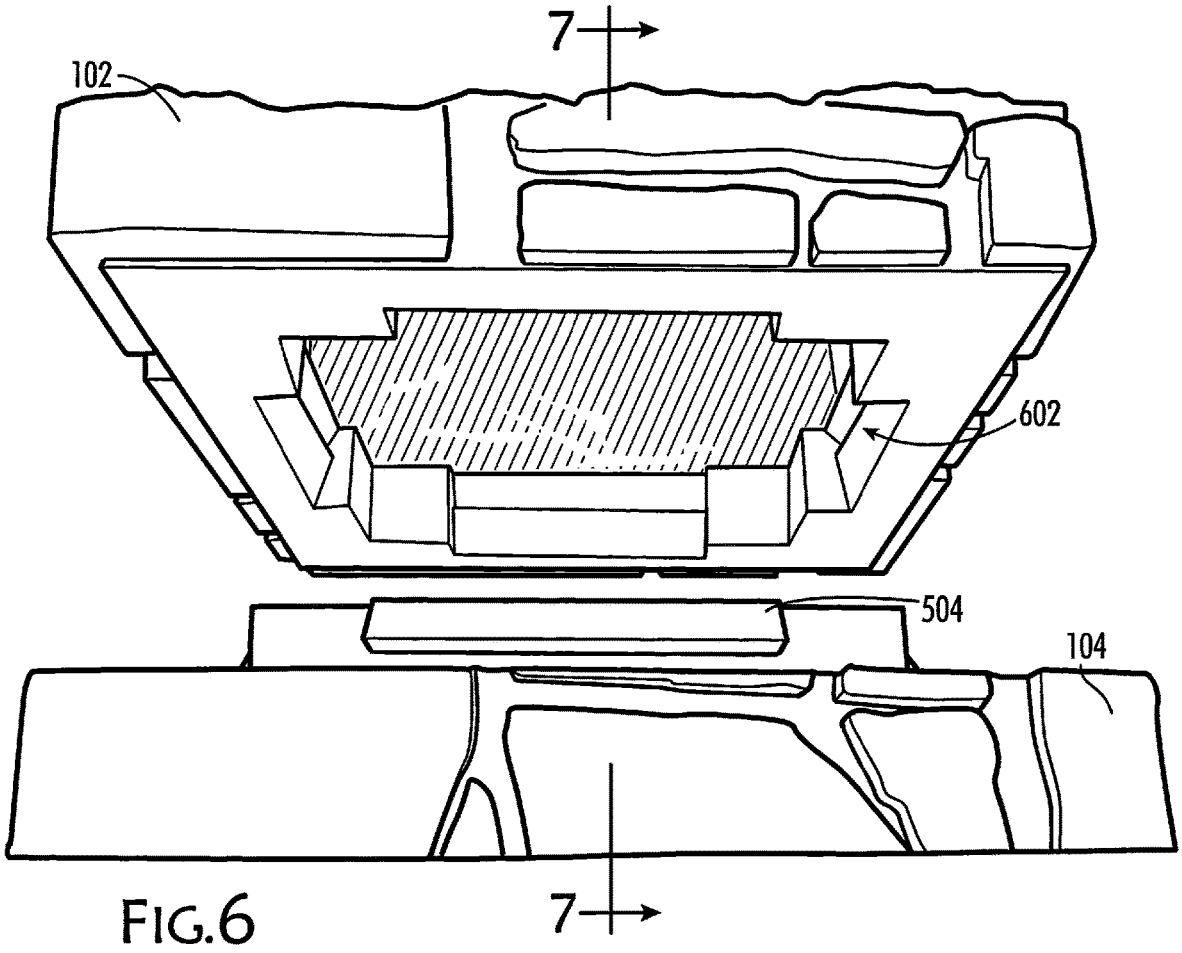
FIG. 6 is a bottom, perspective view of a base of a top structure and the bottom structure of a safety mailbox assembly.

FIG. 6 is a perspective view of a base of the top structure 102 showing a top portion 602 of the snap fit joint, in an aspect. In an embodiment of the invention, the top structure 102 reversibly attaches to the bottom structure 104 through a snap fit connection where the bottom portion 504 acts as the "male" portion of the snap fit and the top portion 602 acts as the "female" portion of the snap fit and together they are shaped as counterparts. It is conceived that the material of construction of the mailbox assembly 100 permits sufficient flexibility to facilitate the snap fit functionality of the connection.

Figure 7:
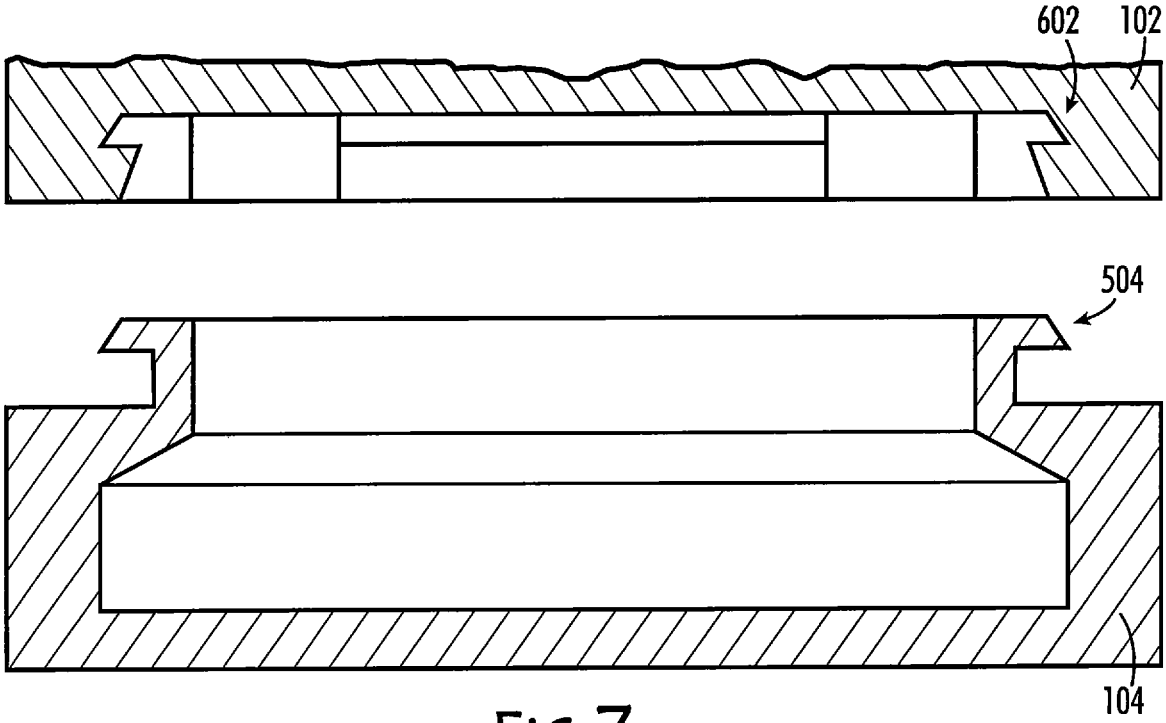
FIG. 7 is a cross-sectional view of a base of a top structure and the bottom structure of a safety mailbox assembly.

FIG. 7 is a cross-section taken as indicated in FIG. 6, which shows in more detail the snap fit connection including the top portion 602 and the bottom portion 504. From this view, it can be seen that the top portion 602 is shaped as a counterpart to accept the biased (sloped for ease of moving the top structure onto the bottom structure) bottom portion 504. It can be further seen that the top portion 602 and the bottom portion 504 are shaped such that when they are snapped together, there is no shape bias in favor of separating the top structure 102 and bottom structure 104. After assembly of the mailbox 100, a portion of the bottom snap fit configuration hangs over onto a ledge of the top portion 602, mechanically preventing separation barring sufficient separating force (e.g. when the top structure 102 is struck by a vehicle).

Figure 8A:
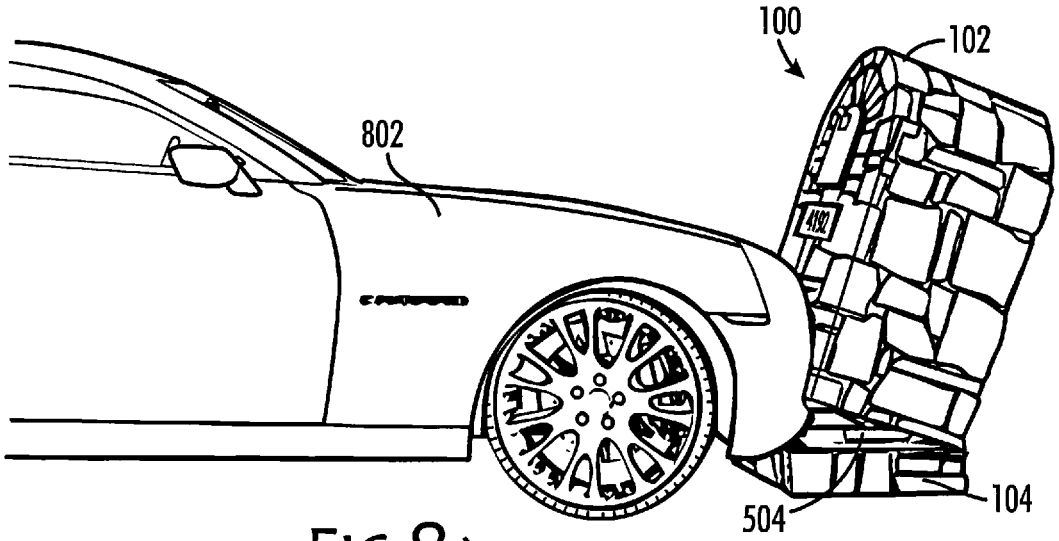
FIGS. 8A-8B are perspective and side views, respectively, of the separation of the top structure and bottom structure of a safety mailbox assembly upon impact of a vehicle; and, FIG. 9 is a flowchart for using a safety mailbox assembly.
Figure 8B:
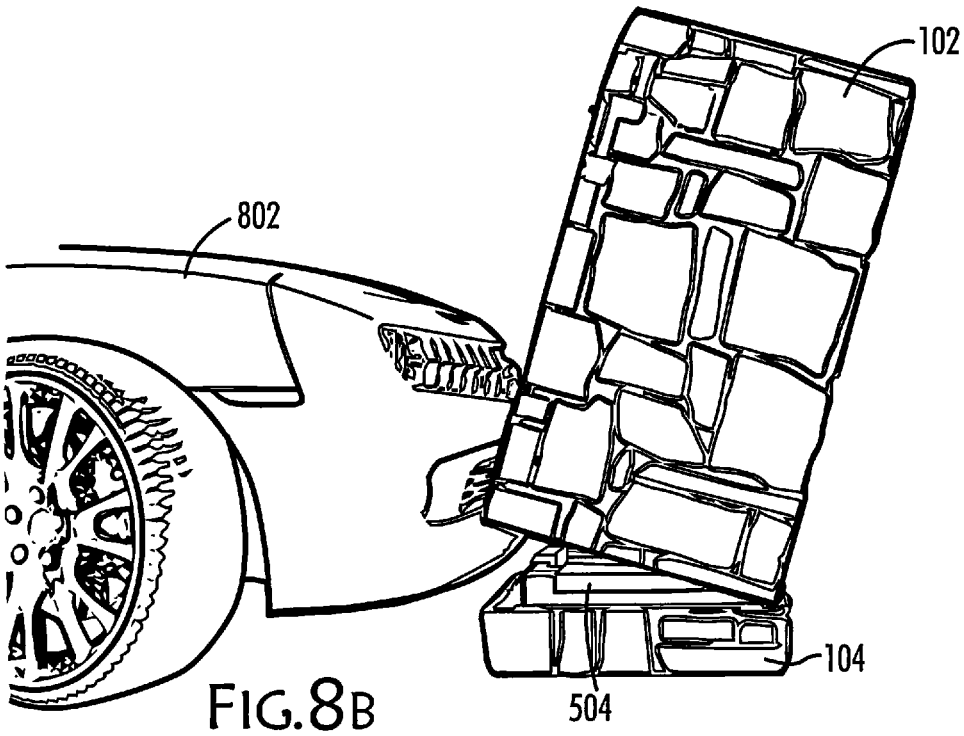

FIGS. 8A-8B are perspective and side views, respectively, of the separation of the top structure 102 and bottom structure 104 of a safety mailbox assembly upon impact from a vehicle 802. As described elsewhere herein, the top structure 102 separates from the bottom structure 104 when a sufficient enough force impacts the top structure 102. In an aspect, this impact force causes the reversible connection between the top structure 102 and bottom structure 104, for example the snap fit joint, to separate, thereby allowing for separation of the top structure 102 from the bottom structure 104. In some aspects, the bottom structure 104 is configured with a modest height dimension, such that the vehicle 802 will pass over the bottom structure 104 safely without any additional collision and/or damage to the vehicle 802.

It is expected that during the life of a patent maturing from this application many relevant mailboxes will be developed and the scope of the term mailbox is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range. Further, described ranges are intended to include numbers outside any range described within statistical error and/or inherent measurement equipment limitations.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A safety mailbox assembly, comprising:

a substantially hollow and post-less top structure configured with a top portion of a reversible connection at a base of the top structure and including at least one mail box disposed therein;

a substantially hollow and post-less bottom structure configured with a bottom portion of the reversible connection;

wherein the reversible connection is a snap fit joint and the top portion and the bottom portion connect together to reversibly connect the top structure and the bottom structure.

2. A safety mailbox assembly of claim 1, wherein the top portion of the reversible connection is configured with a ledge on which the bottom portion hangs when the top portion and the bottom portion are snap fit to each other.

3. A safety mailbox assembly of claim 1, wherein the bottom portion of the reversible connection is biased for insertion into the top portion of the reversible connection.

4. A safety mailbox assembly of claim 1, wherein the top structure represents at least 75% of a total height of the safety mailbox assembly.

5. A safety mailbox assembly of claim 1, wherein the bottom structure is 12 inches in height or less.

6. A safety mailbox assembly of claim 5, having a total height of 65 inches.

7. A safety mailbox assembly of claim 1, wherein the bottom structure has a hollow with a capacity of at least 320 lbs. of dry concrete mix.

8. A safety mailbox assembly of claim 1, wherein an exterior surface of at least the top structure is provided with ornamentation.

9. A safety mailbox assembly of claim 8, wherein the ornamentation is at least one of a wood pattern, a metal pattern, a stone pattern, a color and a design.

10. A safety mailbox assembly of claim 1, having a total height of 65 inches.

11. A method of using a safety mailbox assembly, comprising:

placing a bottom structure at a desired location;

filling a hollow of the bottom structure with a weighty substance; and, reversibly connecting a top structure to the bottom structure with a snap fit joint such that a mail box disposed within the top structure faces in a desired direction.

12. The method according to claim 11, further comprising reconnecting the top structure to the bottom structure after a separating impact.

13. The method according to claim 11, further comprising affixing at least one of street number, street name, and owner name to the top structure.

14. The method according to claim 11, further comprising attaching a mail flag to a side of the top structure.

15. The method according to claim 11, further comprising driving a location stake through the bottom structure at the desired location, prior to the filling.

16. A system for changing the aesthetic appearance of a safety mailbox assembly, comprising:

a plurality of substantially hollow and post-less top structures, each with different exterior surface ornamentation, configured with a top portion of a reversible connection at a base of the top structure and including at least one mail box disposed therein;

at least one substantially hollow and post-less bottom structure configured with a bottom portion of the reversible connection;

wherein the bottom portion is reversibly connectable with a snap fit joint to any of the plurality of top portions to reversibly and interchangeably connect the plurality of top structures to the bottom structure and effectuating the alteration of the appearance of the safety mailbox assembly.

17. The system of claim 16, wherein different exterior surface ornamentation includes at least one of a wood pattern, a metal pattern, a stone pattern, a color and a design.

* * * * *